US008170468B2

(12) United States Patent
Dorfstatter et al.

(10) Patent No.: US 8,170,468 B2
(45) Date of Patent: May 1, 2012

(54) METHOD AND SYSTEM FOR PRESENTING MEDIA CONTENT IN A MOBILE VEHICLE COMMUNICATION SYSTEM

(75) Inventors: Walter A. Dorfstatter, West Bloomfield, MI (US); Russell A. Patenaude, Macomb Township, MI (US); Brad T. Resser, Lake Orion, MI (US)

(73) Assignee: General Motors LLC, Detroit, MI (US)

( * ) Notice: Subject to any disclaimer, the term of this patent is extended or adjusted under 35 U.S.C. 154(b) by 2162 days.

(21) Appl. No.: 11/013,006

(22) Filed: Dec. 15, 2004

(65) Prior Publication Data

US 2006/0128301 A1 Jun. 15, 2006

(51) Int. Cl.
*H04H 1/00* (2006.01)

(52) U.S. Cl. ..... 455/3.04; 455/3.01; 455/3.02; 455/3.06; 455/297

(58) Field of Classification Search ..... 455/3.04, 455/3.01, 3.06, 45, 154.1, 3.02, 427, 553, 455/557, 397; 370/351, 326, 442; 725/131, 725/1, 39; 715/744, 765; 718/100
See application file for complete search history.

(56) References Cited

U.S. PATENT DOCUMENTS

| | | | | |
|---|---|---|---|---|
| 6,243,145 | B1 * | 6/2001 | Schlarb et al. | 725/39 |
| 6,587,127 | B1 * | 7/2003 | Leeke et al. | 715/765 |
| 6,605,770 | B2 * | 8/2003 | Yamane et al. | 84/609 |
| 7,266,343 | B1 * | 9/2007 | Yli-juuti et al. | 455/3.06 |
| 2002/0183059 | A1 * | 12/2002 | Noreen et al. | 455/427 |
| 2003/0014767 | A1 * | 1/2003 | Stumphauzer, II | 725/131 |
| 2004/0141476 | A1 * | 7/2004 | Chumbley et al. | 370/326 |
| 2004/0187133 | A1 * | 9/2004 | Weisshaar et al. | 718/100 |
| 2005/0278750 | A1 * | 12/2005 | Grossman et al. | 725/62 |
| 2005/0283791 | A1 * | 12/2005 | McCarthy et al. | 725/1 |
| 2006/0026162 | A1 * | 2/2006 | Salmonsen et al. | 707/10 |
| 2006/0062363 | A1 * | 3/2006 | Albrett | 379/101.01 |
| 2007/0256021 | A1 * | 11/2007 | Prager et al. | 715/744 |

* cited by examiner

*Primary Examiner* — Tan Trinh

(57) ABSTRACT

A method of presenting channels to the user of a multi-channel wireless media service is provided. A user input is received in a mobile unit, wherein the user input has an associated category. At least one channel of the multi-channel wireless media service responsive to the user input is determined based upon a relationship of the channel to the associated category. Access to the channel is provided to the user. Alternative methods as well as systems and programs for accomplishing the method are provided.

5 Claims, 3 Drawing Sheets

METHOD AND SYSTEM FOR PRESENTING MEDIA CONTENT IN A MOBILE VEHICLE COMMUNICATION SYSTEM

FIELD OF THE INVENTION

This invention relates generally to the management of user media preferences over a wireless communication system. More specifically, the invention relates to a method and system for presenting media content to a user in a mobile vehicle.

BACKGROUND OF THE INVENTION

Several broadcast media services are now available to automobiles and other mobile vehicles, including satellite radio, amplitude modulation (AM) radio, frequency modulation (FM) radio, and television broadcasts. Over 40% of radio listening in the United States takes place in mobile vehicles, the most popular location for receiving radio broadcasts. With the advent of portable media playback devices such as CD and DVD players, even more content is made available in the mobile vehicle.

A satellite radio service provider uses one or more satellites to broadcast content for each of its channels, and often has terrestrial repeaters to improve broadcast coverage in areas of satellite signal blockage. A satellite signal can contain hundreds of channels, the number depending on bandwidth and channel compression, and encoding parameters. Many of these broadcasts may be delivered with additional data such as station identification, song titles, and program schedules. Thus, satellite radio providers offer an overwhelming amount of content to a typical user. Moreover, the typical user can also select from AM radio, FM radio and content from other media channels (such as DVD and television content). Such an array of choices is dazzling at best and may be confusing at worst.

Generally a potential subscriber is only interested in a few stations and a limited amount of content. For example, a typical user may be interested in a limited subset of the myriad content channels offered (e.g. only the sports channels, only the classical music stations or only talk radio. In fact, a user may be interested in only one or two stations within such subsets. In addition a user may also be interested in fairly specific content from other media (e.g. only children's DVD selections.) In many cases, a potential subscriber may be unwilling or unable to read through the station lists and content descriptions of all the available satellite radio stations or the content from all available media channels. Furthermore, a potential subscriber may not wish to spend a great deal of time manually searching through available media channels.

Accordingly, it would be desirable to have a system and method for selecting media content preferences that are targeted to a specific user of a vehicle and for presenting selected media channels to the user. It is an object of this invention, therefore, to provide a method for selecting media preferences in a mobile vehicle communication system, and to overcome the deficiencies and obstacles described above.

SUMMARY OF THE INVENTION

One aspect of the invention is a method of presenting channels to the user of a multi-channel wireless media service. A user input is received in a mobile unit, wherein the user input has an associated category. At least one channel of the multi-channel wireless media service responsive to the user input is determined based upon a relationship of the channel to the associated category. Access to the channel is provided to the user. User input may comprise a channel selection or a response to a request from the in-vehicle unit. A media player may be pre-set with one or more determined channels. A list of determined channels may also be generated and provided to the user.

Another aspect of the present invention is a method of presenting channels to a user of a satellite digital audio radio service. A user input is received in a mobile vehicle. At least one channel of the satellite digital audio radio service is determined responsive to the user input, wherein the at least one channel is representative of categories related to a category of the user input. Access to the channel is provided to the user. User input may comprise a channel selection or a response to a request from the in-vehicle unit. A media player may be pre-set with one or more determined channels. A list of determined channels may also be generated and provided to the user.

Another aspect of the present invention is a system of presenting channels to the user of a multi-channel wireless media service. The system comprises means for receiving a user input in a mobile unit, wherein the user input has an associated category. The system further comprises means for determining at least one channel of the multi-channel wireless media service responsive to the user input based upon a relationship of the channel to the associated category as well as means for providing access to the channel to the user. The system further comprises means for automatically pre-setting a media player with the channel. The system further comprises means for generating a list, wherein the list comprises the determined channels and for providing the list to the user. The system further comprises means for selecting determined channels from the list and means for automatically pre-setting a media player with the determined channels.

Yet another aspect of the present invention is computer usable medium including a program to present channels to the user of a multi-channel wireless media service. The program comprises computer program code that receives a user input in a mobile unit, wherein the user input has an associated category. The program further comprises computer program code that determines at least one channel of the multi-channel wireless media service responsive to the user input based upon a relationship of the channel to the associated category as well as computer program code that provides access to the channel to the user. The program further comprises computer program code that automatically pre-sets a media player with the channel. The program further comprises computer program code that generates a list, wherein the list comprises the determined channels and program code that provides the list to the user. The program further comprises computer program code that selects determined channels from the list and computer program code that automatically pre-sets a media player with the determined channels. The aforementioned and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
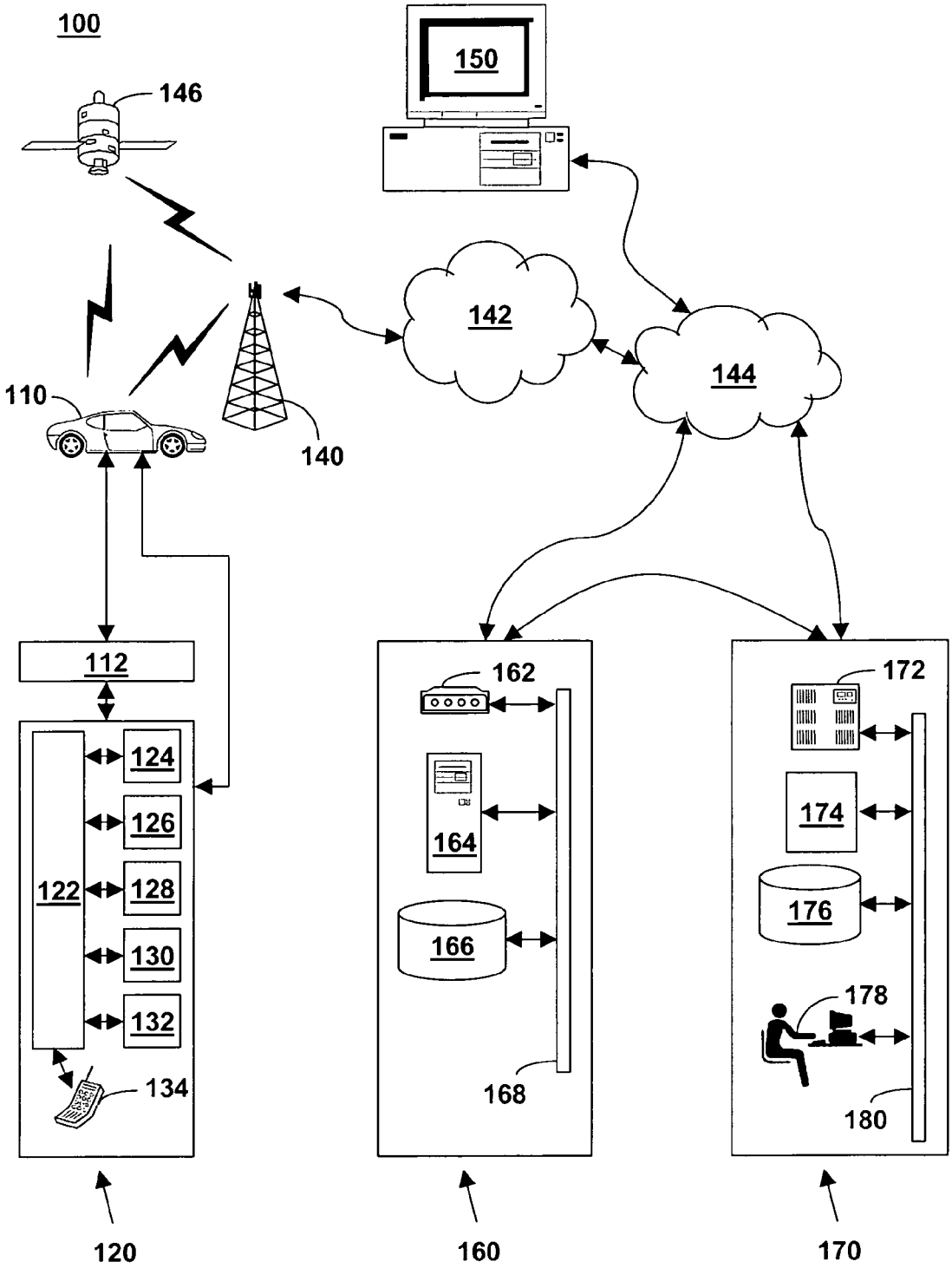
FIG. 1 illustrates a system for presenting media content in a mobile vehicle using a mobile vehicle communication system, in accordance with one embodiment of the current invention.

FIG. 1 illustrates one embodiment of a mobile vehicle communication system (MVCS) 100 for presenting media content in a mobile vehicle. MVCS 100 includes a mobile vehicle communication unit (MVCU) 110, a vehicle communication network 112, a telematics unit 120, one or more wireless carrier systems 140, one or more communication networks 142, one or more land networks 144, one or more satellite broadcast systems 146, one or more client, personal, or user computers 150, one or more web-hosting portals 160, and one or more call centers 170. In one embodiment, MVCU 110 is implemented as a mobile vehicle equipped with suitable hardware and software for transmitting and receiving voice and data communications. MVCS 100 may include additional components not relevant to the present discussion. Mobile vehicle communication systems and telematics units are known in the art.

MVCU 110 is also referred to as a mobile vehicle in the discussion below. In operation, MVCU 110 may be implemented as a motor vehicle, a marine vehicle, or as an aircraft. MVCU 110 may include additional components not relevant to the present discussion.

MVCU 110, via a vehicle communication network 112, sends signals to various units of equipment and systems (detailed below) within MVCU 110 to perform various functions such as unlocking a door, opening the trunk, setting personal comfort settings, and calling from telematics unit 120. These functions are performed by sending electronic instructions to a vehicle module configured to perform a certain task or function. In facilitating interactions among the various communication and electronic modules, vehicle communication network 112 utilizes network interfaces such as controller-area network, International Organization for Standardization (ISO) Standard 9141, ISO Standard 11898 for high-speed applications, ISO Standard 11519 for lower speed applications, and Society of Automotive Engineers Standard J1850 for high-speed and lower speed applications.

MVCU 110, via telematics unit 120, sends to and receives radio transmissions from wireless carrier system 140. Wireless carrier system 140 is implemented as any suitable system for transmitting a signal from MVCU 110 to communication network 142.

Telematics unit 120 includes a processor 122 connected to a wireless modem 124, a global positioning system (GPS) unit 126, an in-vehicle memory 128, a microphone 130, one or more speakers 132, and an embedded or in-vehicle mobile phone 134. In other embodiments, telematics unit 120 may be implemented without one or more of the above listed components such as, for example, speakers 132. In one embodiment of the invention, telematics unit 120 may present suggested or selected media channel content for MVCU 110 in accordance with the method further described below. Telematics unit 120 may include additional components not relevant to the present discussion. Telematics unit 120 is one example of a vehicle module.

In one embodiment, processor 122 is implemented as a microcontroller, controller, host processor, or vehicle communications processor. In one embodiment, processor 122 is a digital signal processor. In another embodiment, processor 122 is implemented as an application-specific integrated circuit. In another embodiment, processor 122 is implemented as a processor working in conjunction with a central processing unit performing the function of a general-purpose processor. GPS unit 126 provides longitude and latitude coordinates of the vehicle responsive to a GPS broadcast signal received from one or more GPS satellite broadcast systems (not shown). In-vehicle mobile phone 134 is a cellular-type phone such as, for example, a digital, dual-mode (e.g., analog and digital), dual-band, multi-mode, or multi-band cellular phone.

Processor 122 executes various computer programs that control programming and operational modes of electronic and mechanical systems within MVCU 110. Processor 122 controls communications (e.g., call signals) between telematics unit 120, wireless carrier system 140, and call center 170. Additionally, processor 122 controls reception of communications from satellite broadcast system 146. In one embodiment, a voice-recognition application is installed in processor 122 that can translate human voice input through microphone 130 to digital signals. Processor 122 generates and accepts digital signals transmitted between telematics unit 120 and vehicle communication network 112 that is connected to various electronic modules in the vehicle. In one embodiment, these digital signals activate programming modes and operation modes, as well as provide for data transfers such as, for example, data over voice channel communication. In this embodiment, signals from processor 122 are translated into voice messages and sent out through speaker 132.

Wireless carrier system 140 is a wireless communications carrier or a mobile telephone system and transmits to and receives signals from one or more MVCU 110. Wireless carrier system 140 incorporates any type of telecommunications in which electromagnetic waves carry signals over part of or the entire communication path. In one embodiment, wireless carrier system 140 is implemented as any type of broadcast communication in addition to satellite broadcast system 146. In another embodiment, wireless carrier system 140 provides broadcast communication to satellite broadcast system 146 for download to MVCU 110. In one example, wireless carrier system 140 connects communication network 142 to land network 144 directly. In another example, wireless carrier system 140 connects communication network 142 to land network 144 indirectly via satellite broadcast system 146.

Satellite broadcast system 146 transmits radio signals to telematics unit 120 within MVCU 110. In one embodiment, satellite broadcast system 146 may broadcast over a spectrum in the "S" band of 2.3 GHz that has been allocated by the U.S. Federal Communications Commission for nationwide broadcasting of satellite-based Digital Audio Radio Service (SDARS).

In operation, broadcast services provided by satellite broadcast system 146 are received by telematics unit 120 located within MVCU 110. In one embodiment, broadcast services include various formatted programs based on a package subscription obtained by the user and managed by telematics unit 120. In another embodiment, broadcast services include various formatted data packets based on a package subscription obtained by the user and managed by call center 170. In an example, processor 122 implements data packets received by telematics unit 120.

Communication network 142 includes services from one or more mobile telephone switching offices and wireless networks. Communication network 142 connects wireless carrier system 140 to land network 144. Communication network 142 is implemented as any suitable system or collection of systems for connecting wireless carrier system 140 to MVCU 110 and land network 144.

Land network 144 connects communication network 142 to computer 150, web-hosting portal 160, and call center 170. In one embodiment, land network 144 is a public-switched telephone network. In another embodiment, land network 144 is implemented as an Internet protocol (IP) network. In other embodiments, land network 144 is implemented as a wired network, an optical network, a fiber network, a wireless network, or a combination thereof. Land network 144 is connected to one or more landline telephones. Communication network 142 and land network 144 connect wireless carrier system 140 to web-hosting portal 160 and call center 170.

Client, personal, or user computer 150 includes a computer usable medium to execute Internet browser and Internet-access computer programs for sending and receiving data over land network 144 and, optionally, wired or wireless communication networks 142 to web-hosting portal 160. Computer 150 sends user preferences to web-hosting portal 160 through a web-page interface using communication standards such as hypertext transport protocol, or transport-control protocol and Internet protocol. In one embodiment, the data includes directives to change certain programming and operational modes of electronic and mechanical systems within MVCU 110.

In operation, a client utilizes computer 150 to initiate setting or re-setting of user preferences for MVCU 110. In an example, a client utilizes computer 150 to select user media channel preferences for MVCU 110. User-preference data from client-side software is transmitted to server-side software of web-hosting portal 160. In an example, user-preference data is stored at web-hosting portal 160.

Web-hosting portal 160 includes one or more data modems 162, one or more web servers 164, one or more databases 166, and a network system 168. Web-hosting portal 160 is connected directly by wire to call center 170, or connected by phone lines to land network 144, which is connected to call center 170. In an example, web-hosting portal 160 is connected to call center 170 utilizing an IP network. In this example, both components, web-hosting portal 160 and call center 170, are connected to land network 144 utilizing the IP network. In another example, web-hosting portal 160 is connected to land network 144 by one or more data modems 162. Land network 144 sends digital data to and receives digital data from data modem 162, data that is then transferred to web server 164. Data modem 162 may reside inside web server 164. Land network 144 transmits data communications between web-hosting portal 160 and call center 170.

Web server 164 receives user-preference data from user computer 150 via land network 144. In alternative embodiments, computer 150 includes a wireless modem to send data to web-hosting portal 160 through a wireless communication network 142 and a land network 144. Data is received by land network 144 and sent to one or more web servers 164. In one embodiment, web server 164 is implemented as any suitable hardware and software capable of providing web services to help change and transmit personal preference settings from a client at computer 150 to telematics unit 120 in MVCU 110. Web server 164 sends to or receives from one or more databases 166 data transmissions via network system 168. Web server 164 includes computer applications and files for managing and storing personalization settings supplied by the client, such as door lock/unlock behavior, radio station preset selections, climate controls, custom button configurations, media content preferences and theft alarm settings. For each client, the web server potentially stores hundreds of preferences for wireless vehicle communication, networking, maintenance, and diagnostic services for a mobile vehicle.

In one embodiment, one or more web servers 164 are networked via network system 168 to distribute user-preference data among its network components such as database 166. In an example, database 166 is a part of or a separate computer from web server 164. Web server 164 sends data transmissions with user preferences to call center 170 through land network 144.

Call center 170 is a location where many calls are received and serviced at the same time, or where many calls are sent at the same time. In one example, the call center is a telematics call center, facilitating communications to and from telematics unit 120 in MVCU 110. In another example, the call center is a voice call center, providing verbal communications between an advisor in the call center and a subscriber in a mobile vehicle. In another example, the call center contains each of these functions. In other embodiments, call center 170 and web-hosting portal 160 are located in the same or different facilities.

Call center 170 contains one or more voice and data switches 172, one or more communication services managers 174, one or more communication services databases 176, one or more communication services advisors 178, and one or more network systems 180.

Switch 172 of call center 170 connects to land network 144. Switch 172 transmits voice or data transmissions from call center 170, and receives voice or data transmissions from telematics unit 120 in MVCU 110 through wireless carrier system 140, communication network 142, and land network 144. Switch 172 receives data transmissions from and sends data transmissions to one or more web-hosting portals 160. Switch 172 receives data transmissions from or sends data transmissions to one or more communication services managers 174 via one or more network systems 180.

Communication services manager 174 is any suitable hardware and software capable of providing requested communication services to telematics unit 120 in MVCU 110. Communication services manager 174 sends to or receives from one or more communication services databases 176 data transmissions via network system 180. Communication services manager 174 sends to or receives from one or more communication services advisors 178 data transmissions via network system 180. Communication services database 176 sends to or receives from communication services advisor 178 data transmissions via network system 180. Communication services advisor 178 receives from or sends to switch 172 voice or data transmissions.

Communication services manager 174 provides one or more of a variety of services including initiating data over voice channel wireless communication, enrollment services, navigation assistance, directory assistance, roadside assistance, business or residential assistance, information services assistance, emergency assistance, and communications assistance. Communication services manager 174 receives service-preference requests for a variety of services from the client via computer 150, web-hosting portal 160, and land network 144. Communication services manager 174 transmits user-preference and other data such as, for example, primary diagnostic script to telematics unit 120 in MVCU 110 through wireless carrier system 140, communication network 142, land network 144, voice and data switch 172, and network system 180. Communication services manager 174 stores or retrieves data and information from communication services database 176. Communication services manager 174 may provide requested information to communication services advisor 178.

In one embodiment, communication services advisor 178 is implemented as a real advisor. In an example, a real advisor is a human being in verbal communication with a user or subscriber (e.g., a client) in MVCU 110 via telematics unit 120. In another embodiment, communication services advisor 178 is implemented as a virtual advisor/automaton. For example, a virtual advisor is implemented as a synthesized voice interface responding to requests from telematics unit 120 in MVCU 110.

Communication services advisor 178 provides services to telematics unit 120 in MVCU 110. Services provided by communication services advisor 178 include enrollment services, navigation assistance, real-time traffic advisories, directory assistance, roadside assistance, business or residential assistance, information services assistance, emergency assistance, automated vehicle diagnostic function, and communications assistance. In one embodiment of the invention, communications services advisor 178 provides selected or suggested media channels to the user according to the method of the present invention. Communication services advisor 178 communicates with telematics unit 120 in MVCU 110 through wireless carrier system 140, communication network 142, and land network 144 using voice transmissions, or through communication services manager 174 and switch 172 using data transmissions. Switch 172 selects between voice transmissions and data transmissions.

In operation, an incoming call is routed to telematics unit 120 within mobile MVCU 110 from call center 170. In one embodiment, the call is routed to telematics unit 120 from call center 170 via land network 144, communication network 142, and wireless carrier system 140. In another embodiment, an outbound communication is routed to telematics unit 120 from call center 170 via land network 144, communication network 142, wireless carrier system 140, and satellite broadcast system 146. In this embodiment, an inbound communication is routed to call center 170 from telematics unit 120 via wireless carrier system 140, communication network 142, and land network 144.

In accordance with one embodiment of the present invention, MVCS 100 serves as a system for managing media content for a target user. A signal is sent to call center 170 indicating that MVCU 110 is receiving media content. Satellite broadcast system 146 may provide the content to MVCU 110. Alternatively, MVCU 110 may be receiving the content from AM radio/FM radio, the in-vehicle DVD player, etc. Call center 170 gathers information about the media content as further described below. Call center 170 gathers information about the user's media preferences for example by reading the AM/FM, CD player, MP3, DVD player, etc., by looking in a categorized database of stations or artists, or by matching the vehicle's current GPS location to local stations to tune to the closest corresponding SDARS channel or the same channel containing related sponsor content.

A media content profile is generated and indexed against the available media content providers. Such indexing may also be accomplished at call center 170. Alternatively, the user may create a media content profile at computer 150. This content may be accessed by call center 170.

The media players in MVCU 110 may then be preset with the matching available content providers. For example, the satellite radio stations in the satellite radio receiver of MVCU 110 may be preset with available satellite provider stations which match the media content profile for the user. Thus, if MVCU 110's radio is tuned to an XM Blues station, this same blues stations could be preset for the user for playback when the vehicle starts or when a call from the vehicle is on hold. Alternatively, a rival station that is also a matching media content provider may be played in order to give the user the option to switch. In another example, if the media content profile indicates that the user has children, the DVD player may be preset to play children's movies. The various media players of MVCU 110 may be physically separated from telematics unit 120 though electronically connected to the unit with a cable or over the vehicle communication network 112, or may be embedded within telematics unit 120. Telematics unit 120 may monitor, filter, and send signals that are received from satellite broadcasts, radio broadcasts, or other wireless communication systems to output devices such as speaker 132 and visual display devices (not shown). In accordance with the present invention, telematics unit 120 may preset the media players of MVCU 110.

Computer program code containing suitable instructions to present media content may reside in part at call center 170, satellite broadcast system 146, MVCU 110, or telematics unit 120. For example, a program including computer program code to gather user media content information and to generate a media content profile for the user may reside at call center 170. Meanwhile, a program including computer program code to preset media players within MVCU 110 may reside at telematics unit 120.

Figure 2:
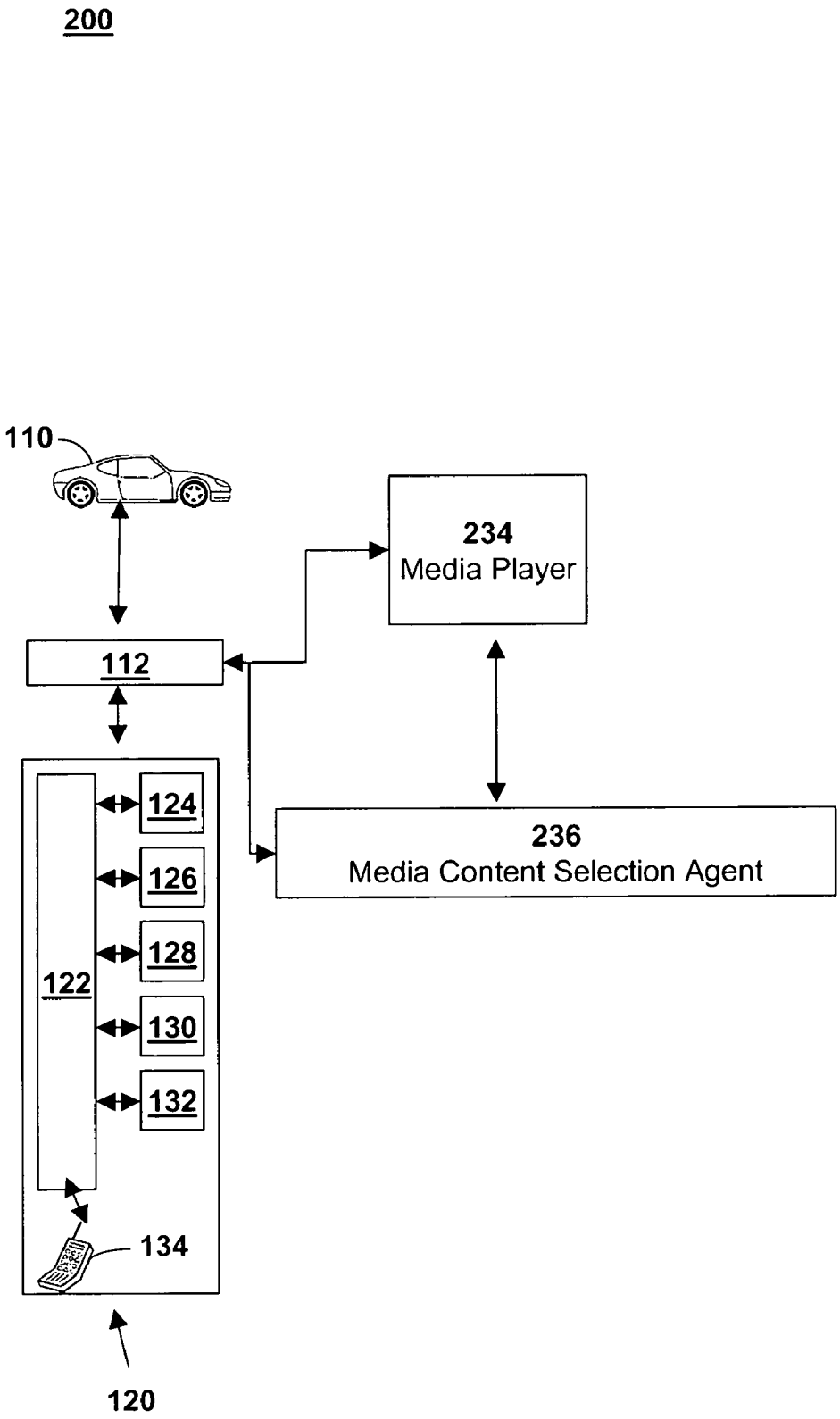
FIG. 2 illustrates a system for presenting media content in a mobile vehicle using a mobile vehicle communication system, in accordance with another embodiment of the current invention.

FIG. 2 illustrates one embodiment of a mobile vehicle communication system (MVCS) 200 for presenting media content in a mobile vehicle. The components shown in FIG. 2 may also be used in conjunction with one or more of the components of mobile vehicle communication system 100, above.

System 200 includes a vehicle network 112, telematics unit 120, and satellite broadcasting system 146 as well as one or more of their separate components, as described above. System 200 further comprises at least one media player 234 and a media content selection agent 236.

Media player 234 is any suitable unit for playing back media content in MVCU 110. Examples of media players include satellite radio units, radio units, DVD players, MP3 players and CD players. The method of the invention may be used for one or more media players in MVCU 110. Media player 234 of MVCU 110 may be physically separated from telematics unit 120 though electronically connected to telematics unit 120 with a cable or over the vehicle communication network 112, or may be embedded within telematics unit 120. Telematics unit 120 may monitor, filter, and send signals that are received from satellite broadcasts, radio broadcasts, or other wireless communication systems to output devices such as speaker 132 and visual display devices (not shown). In accordance with the present invention, telematics unit 120 may preset media player 234 with appropriate settings according to the user's media content profile.

Media content selection agent (MCSA) 236 is any suitable processor for presenting media content for a target user. In one embodiment of the invention, MCSA 236 may be a live agent. Alternatively, MCSA 236 may be an automaton able to query the subscriber as well as able to conduct the activities described further below.

MCSA 236 may reside at or be in communication with telematics unit 120, web hosting portals 160 and/or call center 170. In the embodiment of FIG. 2, MCSA 236 monitors the media content selected in MVCU 110, for example, content manually selected by the user at the satellite radio. MCSA 236 may also monitor other radio content selected by the user such as AM/FM stations currently playing or preset into MVCU's AM/FM radio. MCSA 236 may further monitor radio content available from satellite broadcast system 146. MCSA 236 may further monitor media content from players such as MP3 players, DVD players and CD players.

MCSA 236 may communicate with call center 170 to gather information about the media content preferred by the user. For example, call center 170 may establish a live dialogue between the user and adviser 178 to learn the user's media preferences. MCSA 236 may also gather information about the user's preferred media content from web hosting portal 160. For example, the user may enter preferred media content at computer 150. In addition, MCSA 236 may gather information about the user's preferred media content from telematics unit 120 as well as directly from the user or from one or more of media players 234.

Upon activation, for example, via telematics unit 120, MCSA 236 may also provide to the user a menu tree or interactive voice recognition scheme that allows the user to select preferred media content by interacting with MCSA 236. As stated above, MCSA 236 may be a live agent keeping records of the preferences indicated by the user. Alternatively, MCSA 236 is an automaton capable of logging the user's preferences. MCSA 236, therefore, is able to process spoken preferences and translate these utterances from speech to text for compiling data records of the user's radio preferences.

MCSA 236 also generates a media content profile based on the preferences gathered as described above. MCSA 236 also indexes this profile against the various media providers which are available from such services as satellite broadcasting system 146. MCSA 236 is also able to preset one or more media players 234 in MVCU 110 with available media providers that match the media content profile.

Figure 3:
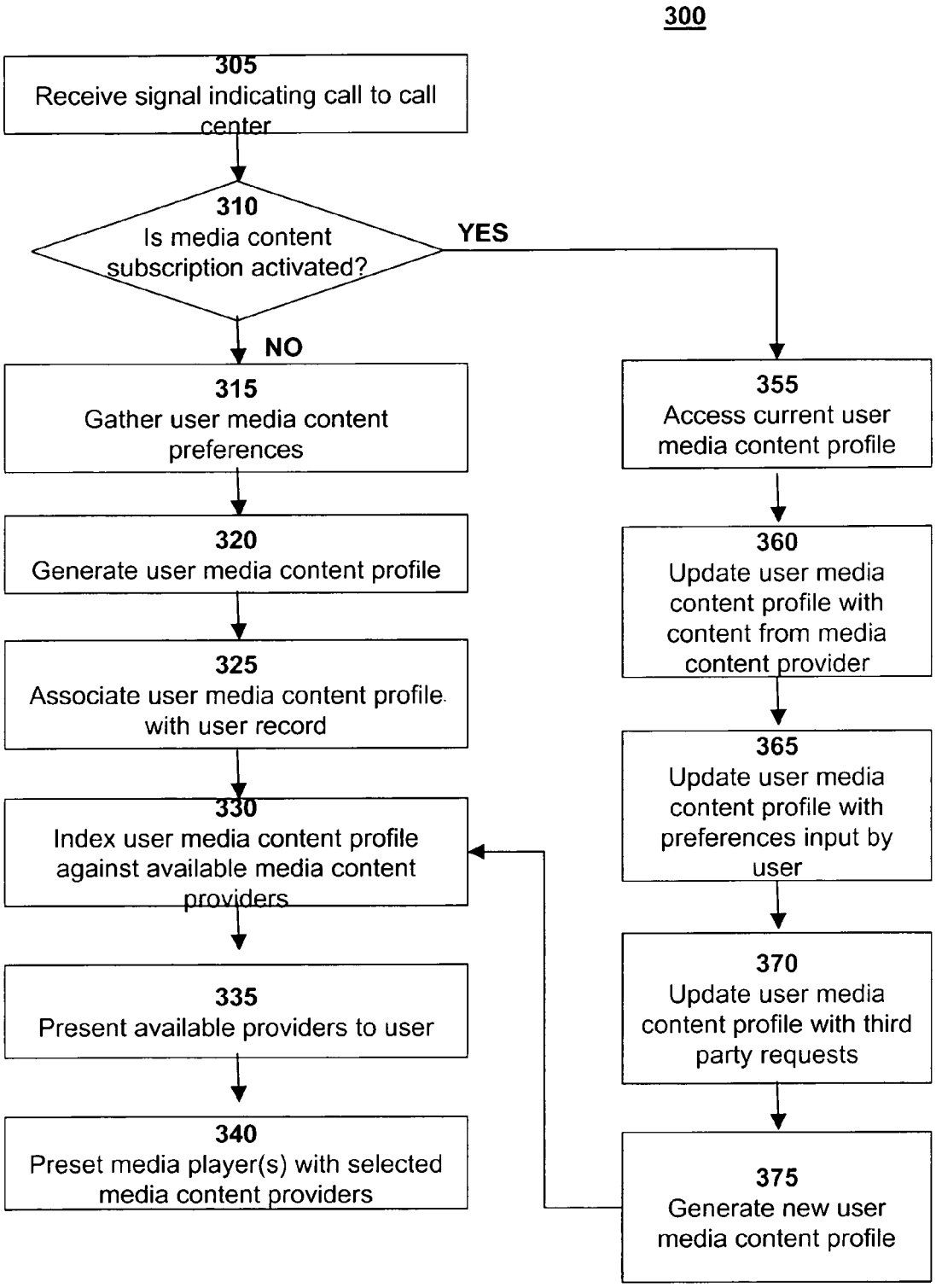
FIG. 3 illustrates a method for presenting media content in a mobile vehicle using a mobile vehicle communication system, in accordance with one embodiment of the current invention.

FIG. 3 illustrates a method 300 for presenting media content in a mobile vehicle using a mobile vehicle communication system, in accordance with one embodiment of the current invention. Although the steps described in method 300 are shown in a given order, the steps are not limited to the order illustrated. Moreover, not every step is required to accomplish the method of the present invention.

As seen at block 305, a signal is received indicating that MVCU 110 has placed a call to call center 170. This may serve to indicate that the user wishes to set his/her media content preferences at this time. In an alternate embodiment, MCSA 236 is directly activated by the user in order to set media content preferences.

As seen at block 310, it is determined whether the user has already activated one or more subscriptions to various available media providers, such as a satellite radio subscription. For example, the method of the present invention occurs when the satellite radio user first activates his/her satellite radio subscription. Thus, if at block 310, no media content subscriptions have been activated, the method proceeds to block 315.

As seen at block 315, the user's media content preferences are gathered. For example, MCSA 236 may communicate with call center 170 (as part of the call established at block 305) to gather information about the media content preferred by the user. Thus, call center 170 may establish a live dialogue between the user and adviser 178 to learn the user's media preferences. The step described at block 315 may also be accomplished as MCSA 236 gathers information about the user's preferred media content from web hosting portal 160. For example, the user may enter preferred media content at computer 150. In addition, the step described at block 315 may be accomplished as MCSA 236 gathers information about the user's preferred media content by querying the user's existing media players, such as querying the vehicle's existing AM/FM radio settings.

Alternatively, MCSA 236 may also accomplish step 315 via telematics unit 120. MCSA 236 may also provide to the user a menu tree or interactive voice recognition scheme that allows the user to select preferred media content by interacting with MCSA 236. As stated above, MCSA 236 may be a live agent keeping records of the preferences indicated by the user. Alternatively, MCSA 236 is an automaton capable of logging the user's preferences. MCSA 236, therefore, is able to process spoken preferences and translate these utterances from speech to text for compiling data records of the user's media preferences.

As described above, the user media preferences are gathered and logged in one or a combination of steps. As seen at block 320, once gathered, a user media content profile is generated from these preferences. Such a profile may indicate, for example, that the user prefers country music stations or classical music stations. Such a profile may further indicate the user's preferred classical music station or even the user's preferred classical music station in a given geographical area.

As seen at block 325, the profile that has been generated is associated with a user record. Typically the user record includes such information as the user's personal information (name, birthdate, etc.), the type of mobile vehicle associated with the telematics unit 120, an identifying number of the vehicle and/or telematics unit, subscriber information (whether the user subscribes to satellite radio, which satellite content providers the user is subscribed to, which communication system providers the user is subscribed to, etc.) and the types of media players available in the vehicle.

As seen at block 330, the profile is indexed against the media channel content that are available to the user. For example, certain stations are made available to the user because he/she is subscribed to a particular satellite content provider. Alternatively, other radio stations are available to the user only in a particular geographical area. Alternatively, other radio stations broadcast only at a particular time. Other media content is available only if the user has an MP3 or CD player. Other media content is available only as DVD content.

As seen at block 335, the list of available media channel content may then be presented to the user for selection. This list may include available content providers as well as the descriptions of the media content available (e.g., "89.7 Windsor, call letters 89X, plays college alternative music" or "children's television channel, plays programs for children under 10"). The list may be presented via one or more media players 234 available in MVCU 110. For example the list may be presented via satellite radio unit 234 so that a user may preview all the stations in the list aurally by listening to a few seconds of each station. Alternatively, MCSA 236 and/or telematics unit 120 may present this data to the user as an immediate verbal response or may send the list to the user via an email through web hosting portals 160.

As seen at block 340, one or more media players 234 may then be pre-set with content providers that the user selects. In one embodiment of the invention, step 335 is an optional step and the method proceeds automatically to step 340 once available content providers have been found at step 330.

Returning now to block 310, once a user's media content subscriptions have already been activated, the method of the present invention may be used to update the user's media content preferences, as well as to cycle through the user's media content profile periodically and discover new content providers for presentation to the user. In addition, the method may be used to eliminate providers which the user chooses to eliminate or which are no longer available to the user for one reason or another. Thus, the user's media player presets remain up-to-date.

As seen at block 355, the user's current media content profile may be periodically accessed. This may occur, for example monthly. Alternatively, this may be initiated by the user. In other embodiments, call center 170 or third-parties prompt the accessing of the media content profile.

As seen at block 360, a media content provider may update the user's current media content profile. For example, the provider may indicate that certain content is now provided on different channels. Alternatively, a given content provider may now be playing a different kind of broadcast (switching from "country music all day long" to "your number one new age hits"). Other content providers may no longer be available to the user because they are not part of the user's media subscription or they no longer broadcast. All of these occurrences may be used to update the user's current media content profile.

As seen at block 365, the user may also update his/her own media content profile. For example, the user's children may have gotten older and the user may wish to have all children's movie channels removed from his/her presets. Alternatively, the user may have developed an interest in 80s music and may indicate that several 80s stations be found and added to his/her presets. In one embodiment of the invention, MCSA 236 monitors the user's usage of the media content preset at block 340 above. If the user does not select a particular preset content provider, the provider may also be removed from the user's preset list. All such preference changes may be used to update the user's current media content profile.

As seen at block 370, third-party requests may also be used to update the user's media content profile. For example, a third party 80s radio station may request that their station be added to the preset list of users listening to alternative 90s rock. MCSA 236 may, for example, present the third-party request to the user while the user is accessing his/her current media profile (e.g., presenting to the user "Why not consider adding this 80s station to your preset stations?" and then playing a sample of the radio station.) Alternatively, while the user is listening to a currently preferred station, MCSA 236 could present a rival station to the user and suggest switching.

As seen at block 375, a new user media content profile is generated based on one or more of steps 360, 365, 370 above.

Method 300 may then return to steps 330, 335 and 340 and index a new profile against the available media channels, select new media content channels and preset one or more media players 234 to the new media channels. The method of the present invention may be repeated periodically as described above to provide the user with updated content and an updated profile.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A method of presenting channels to a user of a multi-channel wireless media service comprising:

at a telematics unit, tracking an interaction of the user with a plurality of media devices to construct a user media preference profile;

receiving a multi-channel wireless media signal at the telematics unit;

determining at least one channel of the multi-channel wireless media signal based upon the user media preference profile; and presetting a media player to play the determined at least one channel without contemporaneous user selection of the channel.

2. The method of claim 1 wherein the interaction of the user with a plurality of media devices comprises a channel selection.

3. The method of claim 1, further comprising:

generating a list, wherein the list comprises the determined at least one channel.

4. The method of claim 3, further comprising:

providing the list to the user.

5. The method of claim 3, further comprising:

selecting determined channels from the list and automatically pre-setting a media player with the determined channels.

* * * * *